US006284069B1

(12) United States Patent
Pircher et al.

(10) Patent No.: US 6,284,069 B1
(45) Date of Patent: Sep. 4, 2001

(54) HOT-ROLLING STEEL STRIP

(75) Inventors: Hans Pircher, Mülheim; Manfred Espenhahn, Essen; Rudolf Kawalla, Bottrop; Waldemar Wolpert, Dinslaken, all of (DE)

(73) Assignee: Thyssen Krupp Stahl AG, Duisburg (DE)

( * ) Notice: Subject to any disclaimer, the term of this patent is extended or adjusted under 35 U.S.C. 154(b) by 0 days.

(21) Appl. No.: 09/381,892

(22) PCT Filed: Mar. 7, 1998

(86) PCT No.: PCT/EP98/01338

§ 371 Date: Dec. 28, 1999

§ 102(e) Date: Dec. 28, 1999

(87) PCT Pub. No.: WO98/42881

PCT Pub. Date: Oct. 1, 1998

(30) Foreign Application Priority Data

Mar. 26, 1997 (DE) ..... 197 12 616

(51) Int. Cl.[7] ..... C21D 8/02

(52) U.S. Cl. ..... 148/654; 148/602; 148/603

(58) Field of Search ..... 148/654, 602, 148/603

(56) References Cited

FOREIGN PATENT DOCUMENTS

406073448 * 3/1994 (JP) ..... 148/654

* cited by examiner

*Primary Examiner*—Deborah Yee
(74) *Attorney, Agent, or Firm*—Proskauer Rose LLP

(57) ABSTRACT

The invention relates to a process for producing strips of homogenous structures and characteristics made of non-alloyed and low-alloyed steel by continuous hot rolling in several roll passes in the austenitic region and subsequently in the ferritic region, as well as coiling. The invention is characterised in that continuous-cast strip and/or strip rough rolled in the austenitic region, starting with a temperature $T \geqq Ar_3 + 30°$ C., with a total degree of deformation of $e_h \geqq 30\%$ is rolled in two or several roll passes in the austenitic region and in that the rolling stock is intensively cooled after every roll pass until the ferritic transformation has been completed, after which the rolling stock is end rolled to final thickness in the ferritic range in several passes with a total degree of deformation $e_h \geqq 60\%$.

12 Claims, No Drawings

HOT-ROLLING STEEL STRIP

This application is a 37 of PCT/EP98/01338 filed Mar. 7, 1998.

The invention relates to a process for producing continuous-cast strips and/or strips rough rolled in the austenitic region, of homogenous structures and characteristics made of non-alloyed and low-alloyed steel by continuous hot rolling in two or several roll passes in the austenitic region, starting with a temperature $T \geqq Ar_3+30°$ C., with a total degree of deformation $e_h \geqq 30\%$ and subsequently in several roll passes in the ferritic region with a total degree of deformation $e_h \geqq 60\%$, as well as coiling.

Various printed publications, e.g. EP 0 306 076 B1, DE 692 02 088, WO 96/12573, EP 0 504 999 A3, EP 0 541 574 B1 and EP 0 370 575 B1, disclose processes according to which hot rolling in the austenitic region is separated from hot rolling in the ferritic region by an in-line arrangement of a cooling line, if necessary with a temperature equalisation line, in front of the finishing group. This is associated with the disadvantage of a relatively long cooling period. To this effect either the cooling line between the roughing group and the finishing group must be sufficiently long which requires considerable space, or else the strip needs to be stopped until the structural transformation has been completed. Both require time and extend the production process to an undesirable degree.

It is the object of the present invention by means of increasing the performance of the cooling line in front of and between the finishing stands, largely to do without additional installations which require additional space, additional time or additional cost.

This object is met in the generic process in that the rolling stock in the finishing group is intensively cooled after every roll pass in the austenitic region and that intensive cooling ends after the ferritic transformation has been completed.

It is advantageous if the process according to the invention is carried out with steels comprising (in mass %) max. 0.06% C, max. 1.5% Si, max. 0.6% Mn, 0.005 to 0.25% P, max. 0.03% S, max. 0.008% N as well as if applicable up to a total of 1.5% of one or several of the elements Al, Ti, Nb, Zr, Cu, Sn, with the remainder being iron including unavoidable impurities.

With hot rolling in the austenitic and ferritic regions according to the invention, the diphasic region austenite/ferrite, which is difficult from the point of view of materials technology and deformation technology, is incorporated into the rolling process but surmounted without any problems by intensive in-line cooling of the rolling stock.

Continuous rolling according to the invention in the austenitic region, in the diphasic region and in the ferritic region, can be applied both in a multi-stand finishing group used for conventional austenitic rolling and in finishing groups of hot-roll mills which process thin slabs directly from the pouring heat.

The temperature setting in the rolling stock takes place in an unerring and accurate manner by means of the variable and step use of cooling groups which for example are provided in the wash descaling plant prior to entering the finishing group and behind the finishing stands. As the hot strip enters the finishing group it is preferably adjusted to an entry temperature in the region of $T \geqq Ar_3+30°$ C. by means of water delivered at high pressure.

Apart from saving space and costs, cooling during continuous finishing rolling provides advantages which have a positive effect on the product quality. By minimising the time during the continuous transition from the austenitic region to the diphasic region and from the diphasic region to the ferritic region, a structural state of high regularity is achieved across the strip width, the strip thickness and the strip length. Hot strip produced according to the invention has a homogenous structure across its cross-section. There is no longer the inhomogeneity across the thickness which can usually be observed with conventional production. The same applies with regard to coarse-grain margins in the region near the surface and in particular in the region of the strip edge. Furthermore, this has a favourable effect on the precipitation state.

The new process is variable within wide limits. By a targeted use of several cooling groups in front of, and in the finishing group, the temperature range of the diphasic region can be differently positioned in the roll-pass plan. By cooling as part of finishing rolling the transformation kinetics austenite/ferrite are accelerated and the temperature of the diphasic region is narrowed to advantage.

Pendulum time is saved which otherwise would be required for temperature reduction between the roughing line and the finishing line.

Furthermore, with the process according to the invention, the rolling temperatures can be set unerringly and very accurately taking into account the $Ar_3$ temperature and in particular the $Ar_1$ temperature. This makes possible ferritic rolling slightly above $Ar_1$ as well as below $Ar_1$. Ferritic rolling close to $Ar_1$ offers the option of saving rolling forces and thus of carrying out roll passes with high reductions which for example are necessary for thin strip below 2.5 mm and even below 1 mm final thickness. When rolling hot strip within the conventional thickness range, the low rolling forces are advantageously used in the production of strip of large width.

The combination of a high final rolling temperature with a high coiling temperature leads to a soft hot strip, i.e. a hot strip of a largely thermally-softened structural state. To do so it is advantageous to use a coiler at a short distance of for example 20 m towards the exit of the last finishing stand. This hot strip comprises the characteristics which are required for direct use of hot strip as stock.

By combining a high final rolling temperature with a low coiling temperature or by combining a low final rolling temperature with a low coiling temperature, hot strips are either thermally softened by a subsequent annealing process or further processed by cold rolling in order to subsequently undergo final heat treatment, with or without a combination of surface refinement.

The above-mentioned combinations of final rolling temperature with coiling temperature offer varied options of exercising a controlling influence on the profile of characteristics of the hot strip for direct consumption or of cold strip produced therefrom. This can easily be proven by texture images.

It is advantageous if in the process according to the invention, the hot strip is finish-rolled in the ferritic range at a temperature ranging from the final transformation temperature of the ferrite to up to 200° C. below it, preferably less than 100° C. below it, and is subsequently coiled at a temperature of $\geqq 650°$ C.

According to a further embodiment of the process according to the invention, at the last 2 seconds after completion of rolling, the hot strip can be cooled to coiling temperature, with liquid and/or gaseous coolants such as water and/or a water-air mixture, at a cooling rate in the core exceeding 10 K/s, with said coiling temperature being more than 200° C. below the $Ar_1$ temperature.

The advantages stated apply both to hot strip for direct consumption and for cold strip produced thereof by subsequent cold rolling at a degree of deformation of ≧30%, preferably ≧60%, and continuous recrystallising annealing or recrystallising annealing in a hood-type furnace.

Thin strip below 3 mm final thickness should be rolled in the ferritic region, preferably with lubricants being applied.

What is claimed is:

1. A process for producing a hot strip made from continuous-cast rolling stock and/or rolling stock rough rolled in the austenitic region, having homogeneous structures and characteristics, made of non-alloyed and low-alloyed steel, comprising the steps of:

hot rolling the rolling stock in a finishing stage in at least two roll passes in the austenitic region, whereby a starting temperature $T \geqq Ar_3+30°$ C., and a total degree of deformation of $e_n \geqq 30\%$, further hot rolling the rolling stock in at least two roll passes in the ferritic region, whereby the degree of deformation $e_n \geqq 60\%$, and subsequently coiling the rolling stock, wherein the rolling stock in the finishing stage is hot rolled in continuous succession in the austenitic region, in the diphasic region and in the ferritic region, wherein during the hot rolling steps, intensively cooling the rolling stock by cooling means after each roll pass, thereby minimizing transformation time from the austenitic to the diphasic region and the diphasic region to the ferritic region, and wherein intensive cooling ceases after ferritic transformation is completed.

2. A process according to claim 1, wherein the intensive cooling takes place after each roll pass, until completion of the ferritic transformation, by applying water or a water-air mixture or a water-steam mixture at a pressure of ≧3 bar.

3. A process according to claim 1, wherein the hot strip is hot rolled from a steel comprising (in mass %); max. 0.06% C, max. 1.5% Si, Max. 0.6% Mn, 0.005 to 0.25% P, max. 0.03% S, max. 0.008% N and up to 1.5% of one or more of the elements selected from the group consisting of Al, Ti, Nb, Zr, Cu, and Sn, remainder iron and unavoidable impurities.

4. A process according to claim 1, wherein the hot strip is finish-rolled in the ferritic range at a temperature between final transformation temperature of the ferrite to 200° C. below the final transformation temperature, and subsequently coiled at a temperature of ≧650° C.

5. A process according to claim 4, wherein the finish-rolling is performed at a temperature between the final transformation temperature of the ferrite to 100° C. below the final transformation temperature in the ferritic range.

6. A process according to claim 1, wherein during the last 2 seconds after completion of rolling, the hot strip is cooled to a coiling temperature with liquid and/or gaseous coolants such as water and/or a water-air mixture, at a cooling rate in the core exceeding 10 K/s, with the coiling temperature being more than 200° C. below $Ar_1$ temperature.

7. A process according to claim 1, wherein after coiling, the hot strip is cold rolled at a degree of deformation of ≧30%.

8. A process according to claim 7, wherein the cold rolled hot strip is subjected to continuous recrystallizing annealing, recrystallizing annealing in a hood-type furnace, and/or to surface refinement.

9. A process according to claim 7, wherein after coiling, the hot strip is cold rolled at a degree of deformation of ≧60%.

10. A process according to claim 9, wherein the cold rolled hot strip is subjected to continuous recrystallizing annealing, recrystallizing annealing in a hood-type furnace, and/or to surface refinement.

11. A process according to claim 4, wherein the hot strip is subjected to continuous recrystallizing annealing, recrystallizing annealing in a hood-type furnace, and/or to surface refinement.

12. A process according to claim 1, wherein the steel strip is end rolled in the ferritic region, with the addition of lubricants, to a thickness below 3 mm.

* * * * *